US008638261B2

(12) United States Patent
Tai et al.

(10) Patent No.: US 8,638,261 B2
(45) Date of Patent: Jan. 28, 2014

(54) MULTI-BAND COMBINED ANTENNA

(75) Inventors: Lung-Sheng Tai, New Taipei (TW); Wen-Fong Su, New Taipei (TW); Chun-Ming Chiu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 213 days.

(21) Appl. No.: 13/218,455

(22) Filed: Aug. 26, 2011

(65) Prior Publication Data

US 2012/0050111 A1 Mar. 1, 2012

(30) Foreign Application Priority Data

Aug. 26, 2010 (TW) ..... 99128572 A

(51) Int. Cl.
*H01Q 1/38* (2006.01)
*H01Q 1/48* (2006.01)

(52) U.S. Cl.
USPC ..... 343/700 MS; 343/846

(58) Field of Classification Search
None
See application file for complete search history.

(56) References Cited

U.S. PATENT DOCUMENTS

| | | | | |
|---|---|---|---|---|
| 7,289,071 | B2 * | 10/2007 | Hung et al. | 343/702 |
| 7,868,831 | B2 * | 1/2011 | Hung et al. | 343/700 MS |
| 7,924,230 | B2 * | 4/2011 | Hung et al. | 343/702 |
| 2007/0040754 | A1 * | 2/2007 | Liu et al. | 343/702 |
| 2007/0120753 | A1 * | 5/2007 | Hung et al. | 343/702 |
| 2009/0115665 | A1 * | 5/2009 | Hung et al. | 343/700 MS |
| 2010/0315294 | A1 * | 12/2010 | Chang et al. | 343/700 MS |

* cited by examiner

*Primary Examiner* — Trinh Dinh
(74) *Attorney, Agent, or Firm* — Wei Te Chung; Ming Chieh Chang

(57) ABSTRACT

A multi-band antenna includes a grounding element, a first antenna working on a wireless wide area network, a second antenna working on a wireless local area network, and a third antenna operating on a wireless local area network. The first antenna includes a first conductive piece, a first radiating element extending from the first conductive arm, a coupling radiating element and a feeding line. The second antenna includes a second conductive piece, a first resonant element extending from the second conductive piece, a second resonant element and a feeding line. The third antenna includes a third conductive element, a first conductive arm extending from the third conductive element and a second conductive arm and a feeding line. The first conductive piece is connected to the second conductive piece.

18 Claims, 4 Drawing Sheets

MULTI-BAND COMBINED ANTENNA

RELATED APPLICATIONS

This application claims priority under 35 U.S.C. 119 from TAIWAN Application No. 099128572 filed Aug. 26, 2010, the contents of which are incorporated herein by references.

BACKGROUND OF THE INVENTION

1. Field of the Invention

The present invention relates generally to a multi-band antenna, specially, that the antenna combining at least three antennas used in two different frequency bands.

2. Description of the Prior Art

For the development of the wireless transmitting technology, more and more antennas used in different frequency bands are need to be assembled in an electronic device. At the same time, the electronic device is need to be thinner and lighter. Thus, the antennas in the electronic device is designed to be lower and smaller. TW Patent Publication No. 200922001, published on May 16, 2009, discloses a multi-band antenna which includes a wireless wide area net antenna and two wireless local area. The three antennas are integrated on the same grounding element. However, the three antennas respectively extend from different positions of the grounding element to occupy a big space.

Hence, in this art, an improved multi-band antenna to overcome the above-mentioned disadvantages of the prior art should be provided.

BRIEF SUMMARY OF THE INVENTION

A primary object, therefore, of the present invention is to provide a low-profile antenna with an improved connecting element.

In order to implement the above object, the multi-band antenna comprises a grounding element, a first antenna working on a wireless wide area network, a second antenna working on a wireless local area network, and a third antenna operating on a wireless local area network. The first antenna comprises a first conductive piece, a first radiating element extending from the first conductive arm, a coupling radiating element and a feeding line. The second antenna comprises a second conductive piece, a first resonant element extending from the second conductive piece, a second resonant element and a feeding line. The third antenna comprises a third conductive element, a first conductive arm extending from the third conductive element and a second conductive arm and a feeding line. The first conductive piece is connected to the second conductive piece.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
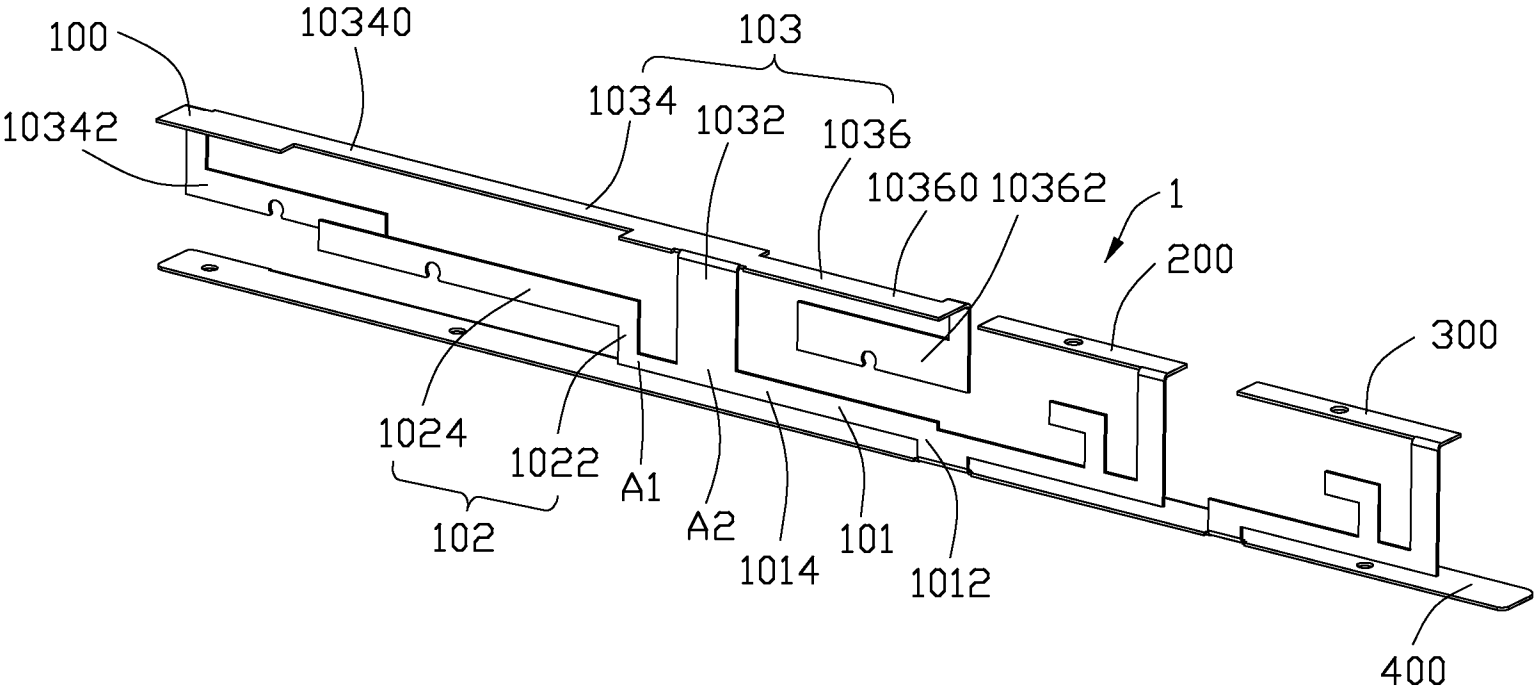
FIG. 1 is a perspective view illustrating a multi-band antenna according to a preferred embodiment of the present invention.
Figure 2:
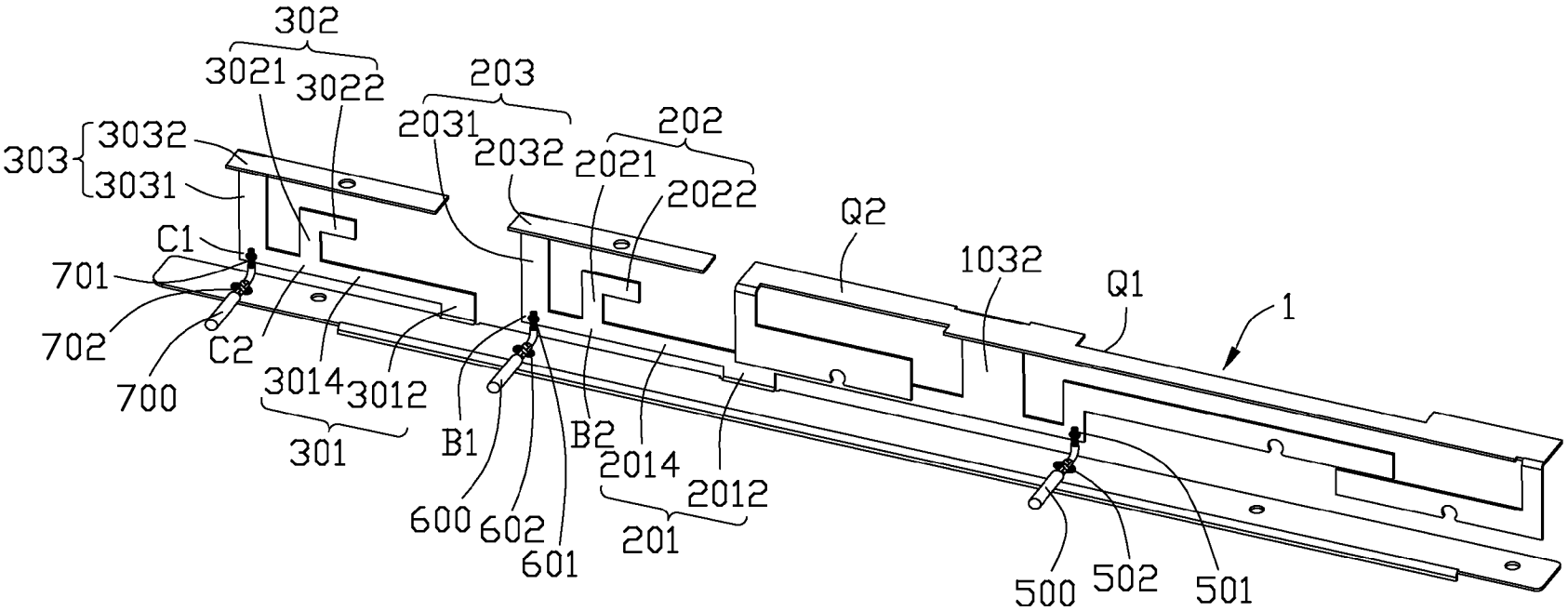
FIG. 2 is a perspective view similar to FIG. 1, but with feeding lines and viewed from another angle.

Reference to FIGS. 1 to 2, a multi-band antenna 1 comprises a grounding element 400, a first antenna 100 used in Wireless Wide Area Network (WWAN), a second antenna 200 used in Wireless Local Area Network (WLAN), and a third antenna 300 used in Wireless Local Area Network.

The first antenna 100 comprises a first conductive piece 101 extending from the grounding element 400 along a first direction, a coupling radiating element 102 extending from the first conductive piece 101 along a first direction, a first radiating element 103 extending from the first conductive piece 101 and apart from the coupling radiating element 102 along a first direction, and a feeding line 500. The first conductive piece 101 is of L shape, and comprises a first side arm 1012 perpendicular to the grounding element 400 and a second side arm 1014 extending from the first side arm 1012 and perpendicular to the grounding element 400. The coupling radiating element 102 is of L shape, and comprises a first branch portion 1022 extending upward from an end of the first conductive piece 101 along a direction perpendicular to the first conductive piece 101 and the grounding element 400, and a second branch portion 1024. The coupling radiating element 102 is connected to the first conductive piece 101 on a first joint point A1. The first radiating element 103 is connected to the first conductive piece 101 on a second joint point A2, and comprises a first radiating arm 1032 upward extending from the first conductive piece 101, a second radiating arm 1034 extending from the end of the first radiating arm 1032 along a first direction, and a third radiating arm 1036 extending from the end of the first radiating arm 1032 along a second direction opposite to the first direction. The second radiating arm 1034 comprises a first side arm 10340 extending from the first radiating arm 1032 along a direction parallel to the grounding element 400, and a second side arm 10342 downward extending from the end of one side the first side arm 10340 and located between the first side arm 10340 and the grounding element 400. A first cutout Q1 is formed on one side of the first side arm 10340 and inward extends from the edge of the side of the first side arm 10340. The second side arm 10342 is of L shape and extends from the other side opposite to the side owning the first cutout Q1. The second side arm 10342 is perpendicular to the grounding element 400 and located on one side of the first side arm 10340 with the coupling radiating element 102 located on the other side of the first side arm 10340. The third radiating arm 1036 comprises a first side arm 10360 extending from the first radiating arm 1032 in a direction parallel to the grounding element 400, and a second side arm 10362 downward extending from the end of the first side arm 10360. A second cutout Q2 is formed on one side of the first side arm 10360 of the third radiating arm 1036 and inward extends from the edge of the side of the first side arm 10360. The second side arm 10362 is of L shape and extends from the other side opposite to the side owning the cutout Q2. The second side arm 10362 of the third radiating arm 1036 is located between the first side arm 10360 and the grounding element 400. The feeding line 500 comprises an inner conductor 501 connected to the first joint point A1 of the first conductive piece 101 and an outer conductor 502 connected to the grounding element 400.

The second antenna 200 comprises a second conductive piece 201 extending from the grounding element 400 along the second direction, a first resonant element 202 extending from the second conductive piece 201, a second resonant element 203 and a feeding line 600. The second conductive piece 201 is of L shape and comprises a first branch 2012 extending from the grounding element 400 and connected to the first conductive piece 101, and a second branch 2014 extending from the end of the first branch 2012 along a direction perpendicular to the grounding element 400. The second resonant element 203 extends from the end of the second conductive piece 201 to be connected to the second conductive piece 201 on a third joint point B1. The second resonant element 203 comprises a first side arm 2031 upward extending from the second conductive element 201 along a vertical direction and a second side arm 2032 extending from the first side arm 2031 along the first direction parallel to the grounding element 400. The first resonant element 202 extends from the second conductive piece 201 and is connected to the second conductive piece 201 on a fourth joint point B2. The first resonant element 202 is apart from the second resonant element 203 and comprises a first side arm 2021 upward extending from the second conductive piece 201 along the vertical direction and a second side arm 2022 extending from the end of the first side arm 2021 along a direction perpendicular to the grounding element 400. The first resonant element 202 is located between the second resonant element 203 and the second conductive element 201. The feeding line 600 comprises an inner conductor 601 connected to the second conductive piece 201 on the third joint point B1 and an outer conductor 602 connected to the grounding element 400.

The third antenna 300 has the same structure as the second antenna 200. However, the third antenna 300 extends from the grounding element 400 lonely but not is connected to the first antenna 100 and the second antenna 200. The third antenna 300 is apart from the second antenna 200 and the second antenna is between the first antenna 100 and the third antenna 300. The third antenna 300 comprises a third conductive piece 301, a first conductive arm 302 extending from the third conductive piece 301, a second conductive arm 303 and a feeding line 700. The third conductive piece 301 is of L shape and comprises a first side arm 3012 extending from the grounding element 400 and a second side arm 3014 extending from the end of the first side arm 3012 along the second direction and perpendicular to the grounding element 400. The second conductive arm 303 extends from the end of the third conductive piece 301 and is connected to the third conductive piece 301 on a fifth joint point C1. The second conductive arm 303 comprises a first side arm 3031 upward extending from the third conductive piece 301 along a vertical direction, and a second side arm 3032 extending from the end of the first side arm 3031 along the first direction and parallel to the grounding element 400. The first conductive arm 302 extends from the third conductive piece 301 and is connected to the third conductive piece 301 on a sixth joint point C2. The first conductive arm 302 is apart from the second conductive arm 303 and comprises a first side arm 3021 upward extending from the third conductive piece 301 in a vertical direction and a second side arm 3022 extending from the end of the first side arm 3021 along the first direction and perpendicular to the grounding element 400. The first conductive arm 302 is located between the second conductive arm 303 and the conductive piece 301. The feeding line 700 comprises an inner conductor 701 connected to the third conductive piece 301 on the fifth joint point C1 and an outer conductor connected to the grounding element 400.

Figure 3:
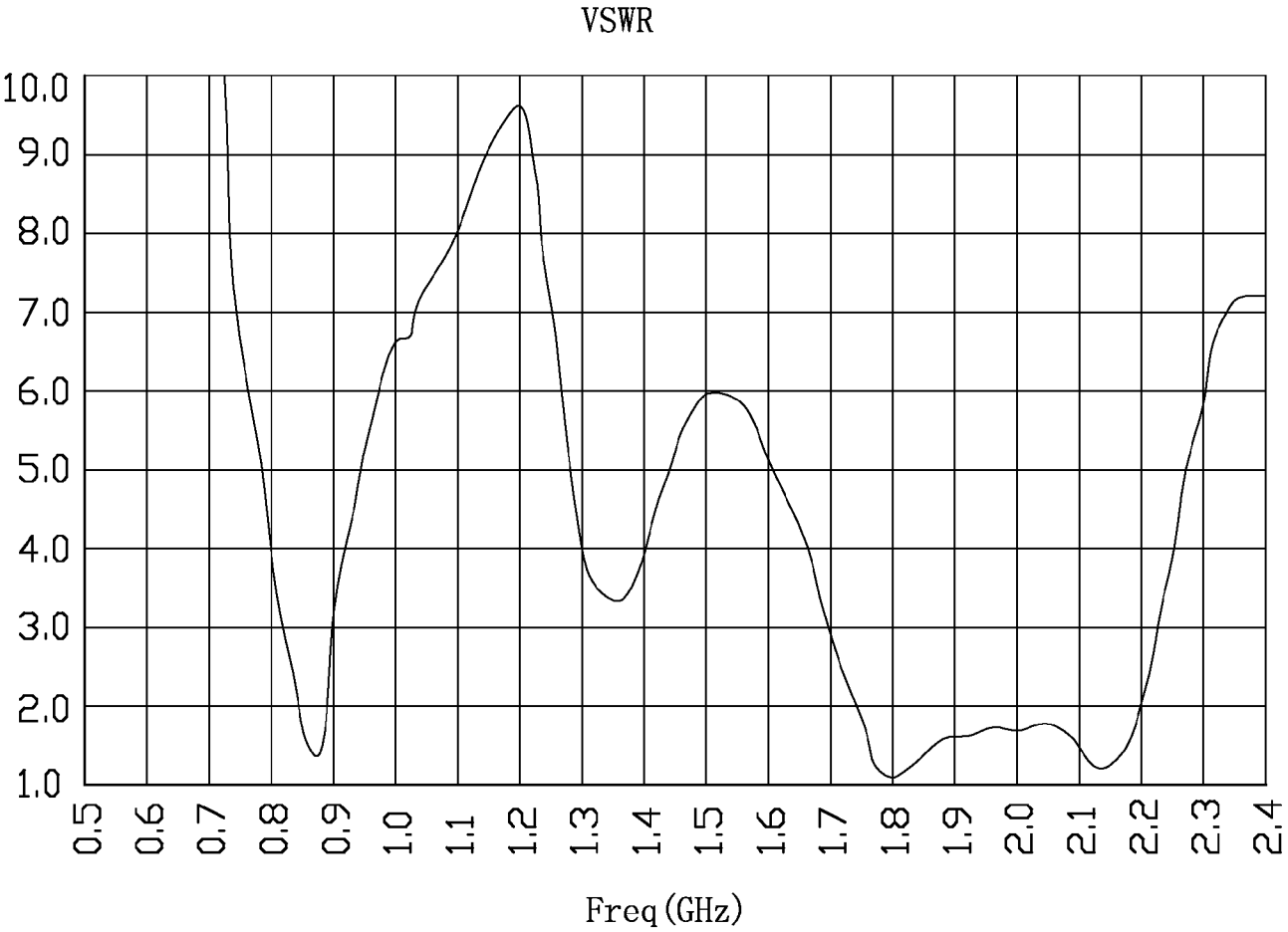
FIG. 3 is a test chart recording for an antenna of the antenna assembly of FIG. 1, showing Voltage Standing Wave Ratio (VSWR) as a function of Wireless Wide Area Network frequency.
Figure 4:
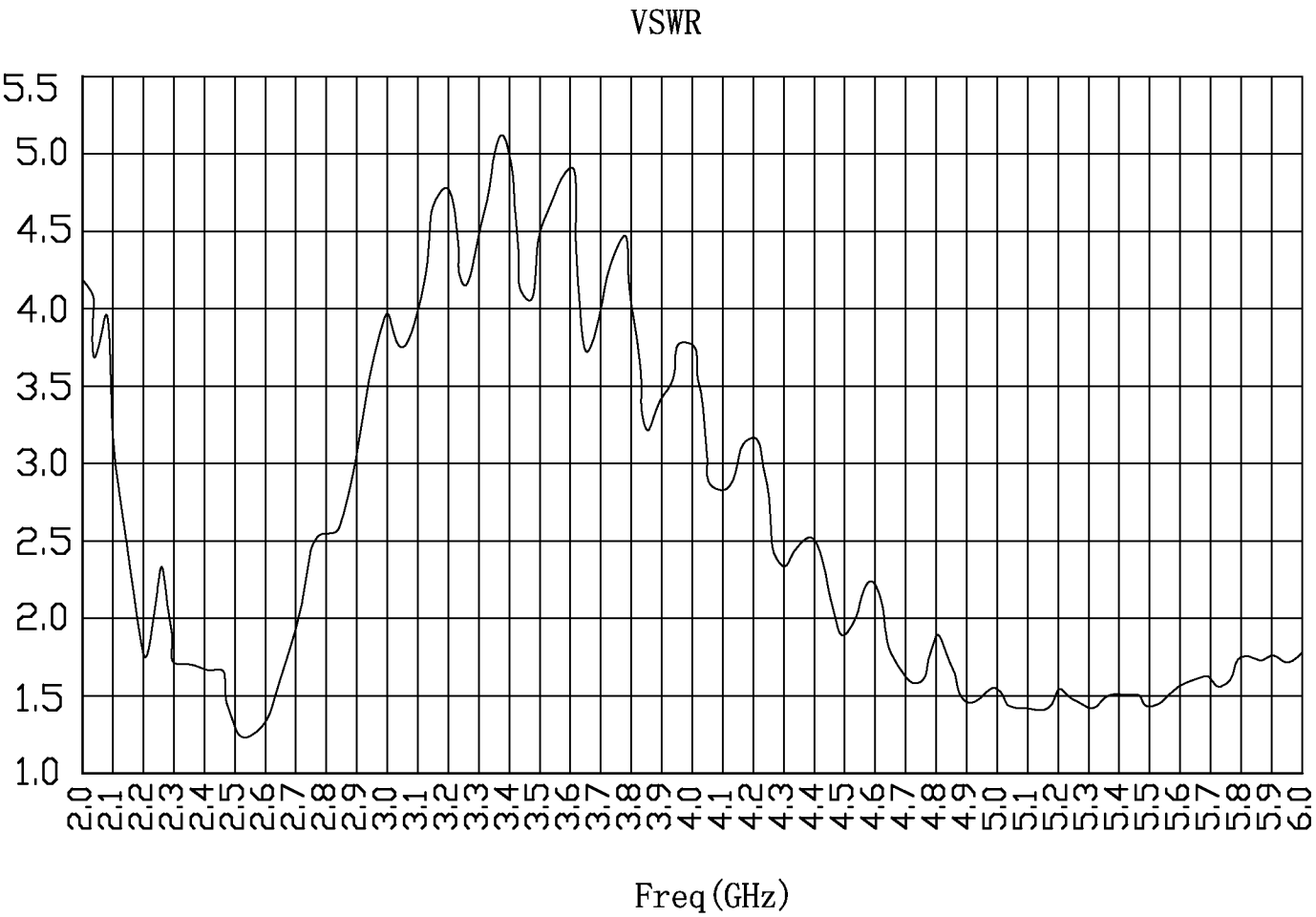
FIG. 4 is a test chart recording for an antenna of the antenna assembly of FIG. 1, showing Voltage Standing Wave Ratio (VSWR) as a function of Wireless Local Area Network frequency.

Referencing to FIGS. 3 and 4, the first antenna 100 of this invention is used in wireless wide area network and works on 800-900 MHz and 1700-2200 MHz. The second antenna 200 and the third antenna 300 are wireless local area network antenna and operate on 2.3-2.7 GHz and 4.7-5.9 GHz. The first conductive piece 101 of the first antenna 100 is connected to the second conductive piece 201 of the second antenna 200 for reduce the hole volume of the multi-band antenna 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element;

a first antenna working on a wireless wide area network, and comprising a first conductive piece, a first radiating element extending from the first conductive piece, a coupling radiating element and a feeding line;

a second antenna working on a wireless local area network, and comprising a second conductive piece, a first resonant element extending from the second conductive piece, a second resonant element and a feeding line;

a third antenna operating on a wireless local area network, and comprising a third conductive piece, a first conductive arm extending from the third conductive piece and a second conductive arm and a feeding line; wherein said first conductive piece is connected to the second conductive piece;

wherein said first conductive piece extends from the grounding element along a first direction, the coupling radiating element extends from an end of the first conductive piece along the first direction, the first radiating element extends from the first conductive piece and is apart from the coupling radiating element;

wherein said first conductive piece of L shape and comprising a first side arm perpendicular to the grounding element, a second side arm extending from the first side arm and perpendicular to the first side arm and the grounding element, said coupling radiating element is connected to the first conductive piece on a first joint point.

2. The multi-band antenna as claimed in claim 1, wherein said first radiating element is connected to the first conductive piece on a second joint point, and comprises first radiating arm upward extending from the first conductive piece, a second radiating arm extending from an end of the first radiating arm along the first direction and a third radiating arm extending from the end of the end of the first radiating arm along a second direction opposite to the first direction.

3. The multi-band antenna as claimed in claim 2, wherein said second radiating arm comprises a first side arm extending from the first radiating arm along a direction parallel to the grounding element, and a second side arm downward extending from the end of one side the first side arm and located between the first side arm and the grounding element.

4. The multi-band antenna as claimed in claim 3, wherein said second side arm of the second radiating arm is of L shape and is located on one side of the first side arm with the coupling radiating element located on the other side of the first side arm.

5. The multi-band antenna as claimed in claim 4, wherein said third radiating arm comprises a first side arm extending from the first radiating arm in a direction parallel to the grounding element, and a second side arm downward extending from the end of the first side arm.

6. The multi-band antenna as claimed in claim 5, wherein said a first cutout is formed on one side of the first side arm and inward extends from the edge of the side of the first side arm, the second side arm is of L shape and extends from the other side opposite to the side owning the cutout.

7. The multi-band antenna as claimed in claim 6, wherein a second cutout is formed on one side of the first side arm of the third radiating arm and inward extends from the edge of the side of the first side arm, the second side arm is of L shape and extends from the other side opposite to the side owning the cutout, the second side arm of the third radiating arm is located between the first side arm and the grounding element.

8. The multi-band antenna as claimed in claim 1, wherein said second conductive piece is of L shape and comprises a first side am extending from the grounding element along a vertical direction and a second side arm extending from the first side arm along a second direction and perpendicular to the grounding element.

9. The multi-band antenna as claimed in claim 1, wherein said second resonant element extends from the end of the second conductive piece to be connected to the second conductive piece on a third joint point.

10. The multi-band antenna as claimed in claim 1, wherein said second resonant element comprises a first side arm upward extending from the second conductive element along a vertical direction and a second side arm extending from the first side arm along the first direction parallel to the grounding element.

11. The multi-band antenna as claimed in claim 10, wherein said first resonant element extends from the second conductive piece and is connected to the second conductive piece on a fourth joint point, the first resonant element is apart from the second resonant element and comprises a first side arm upward extending from the second conductive piece along the vertical direction and a second side arm extending from the end of the first side arm along a direction perpendicular to the grounding element.

12. The multi-band antenna as claimed in claim 11, wherein said first resonant element is located between the second resonant element and the second conductive element.

13. The multi-band antenna as claimed in claim 1, wherein the second antenna and the third antenna have the same structure.

14. A multi-band antenna comprising:

a horizontal grounding element extending along a lengthwise direction;

a first conductive piece joined with a second conductive piece along the lengthwise direction and commonly upwardly extending from the grounding element in a vertical direction perpendicular to said lengthwise direction while extending in opposite first and second directions along said lengthwise direction; so as to form first and second antennas, respectively, the first antenna including a first radiating arm extending upwardly from the first conductive piece, and second and third radiating arms respectively formed on two sides of the first radiating arm in said first direction and second direction, respectively; wherein the second radiating arm includes a first side arm extending from the first radiating arm and parallel to the grounding element, and a vertical L-shaped second side arm downwardly extending from a distal end of the second radiating arm; the third radiating arm includes another first side arm extending from the first radiating arm and parallel to the grounding element, and another vertical L-shaped second side arm downwardly extending from a distal end of said another first side arm under condition that the vertical L-shaped second side arm and said another vertical L-shaped second side arm are essentially located in a same vertical plane while the first radiating arm is located in another vertical plane.

15. The multi-band antenna as claimed in claim 14, wherein said vertical L-shaped second side arm and said another vertical L-shaped second side arm direct opposite to each other.

16. The multi-band antenna as claimed in claim 14, wherein the first side arm defines a cutout in an edge thereof along the longitudinal direction, and said another first side arm defines another cutout in an edge thereof along the longitudinal direction, and said cutout and said another cutout are not aligned with each other in the longitudinal direction.

17. A multi-band antenna comprising:

a horizontal grounding element extending along a lengthwise direction;

a first antenna and a second antenna having the same configuration with each other while respectively connected, via corresponding conductive pieces, to different positions of an edge of the grounding element in a spaced relation therebetween in the lengthwise direction, each of said first antenna and said second antenna defining a small L-shaped conductive arm located under a large L-shaped conductive arm; and a third antenna having a different configuration from those of the first antenna and the second antenna while having a conductive piece joined with that of the first antenna in the lengthwise direction so as to form the first antenna is located between the second antenna and the third antenna in said lengthwise direction, and the first antenna and the second antenna are spaced from each other in the lengthwise direction while the first antenna and the third antenna are joined with each other in the lengthwise direction.

18. The multi-band antenna as claimed in claim 17, wherein the small L-shaped conductive arm includes a vertical section and a horizontal section lying in a same vertical plane while the large L-shaped conductive arm includes another vertical section lying in said same vertical plane and another horizontal second section lying in a horizontal plane.

* * * * *